US009263011B2

(12) United States Patent
Wdowiak

(10) Patent No.: US 9,263,011 B2
(45) Date of Patent: Feb. 16, 2016

(54) CUSTOM PRINTED REMOVABLE BASS DRUM HEAD COVER

(71) Applicant: Angie Wdowiak, Chicago, IL (US)

(72) Inventor: Angie Wdowiak, Chicago, IL (US)

( * ) Notice: Subject to any disclaimer, the term of this patent is extended or adjusted under 35 U.S.C. 154(b) by 51 days.

(21) Appl. No.: 14/219,566

(22) Filed: Mar. 19, 2014

(65) Prior Publication Data

US 2015/0269920 A1 Sep. 24, 2015

(51) Int. Cl.
*G10D 3/00* (2006.01)
*G10D 13/02* (2006.01)

(52) U.S. Cl.
CPC ..... *G10D 13/026* (2013.01); *G10D 13/027* (2013.01)

(58) Field of Classification Search
CPC ... G10D 13/026; G10D 13/00; G10D 13/027; G10D 3/00
USPC ..... 84/411 R, 421
See application file for complete search history.

(56) References Cited

U.S. PATENT DOCUMENTS

| | | | | |
|---|---|---|---|---|
| 2003/0129058 | A1* | 7/2003 | Carollo | 416/5 |
| 2004/0139839 | A1 | 7/2004 | Chiang | |
| 2007/0064322 | A1* | 3/2007 | Migitaka et al. | 359/885 |
| 2007/0158228 | A1* | 7/2007 | Bourgoin | 206/446 |
| 2007/0256532 | A1 | 11/2007 | Lu | |
| 2015/0122107 | A1* | 5/2015 | deLoache et al. | 84/414 |

* cited by examiner

*Primary Examiner* — Kimberly Lockett

(57) ABSTRACT

A removable bass drum head cover with a printed display is provided. The drum head cover may be releasably attachable to a bass drum head. In certain embodiments, the drum head cover may be releasably attachable to the bass drum head cover by a hook and loop fastener. Therefore, drummers may easily interchange the designs, artwork, and band names displayed on their bass drum heads.

6 Claims, 4 Drawing Sheets

CUSTOM PRINTED REMOVABLE BASS DRUM HEAD COVER

BACKGROUND OF THE INVENTION

The present invention relates to a bass drum head cover and, more particularly, to a custom printed removable bass drum head cover.

A drummer is a musician who plays drums, which includes a drum kit ("drum set" or "trap set", including but not limited to cymbals) and accessory based hardware which includes an assortment of pedals and standing support mechanisms, marching percussion, and/or any musical instrument that is struck within the context of a wide assortment of musical genres. To promote a band, it is common for drummers to place band logos or names on the bass drum. To do this, drummers having to invest in an expensive permanent application to display band logos, artwork or advertising on their bass drum heads. This may be inconvenient if the drummer is part of multiple bands, or multiple bands are sharing the same drum set on tour.

As can be seen, there is a need for removable designs that are attachable to bass drum heads.

SUMMARY OF THE INVENTION

In one aspect of the present invention, an apparatus comprises: a cover comprising a front surface and a rear surface, wherein the front surface comprises a printed display; and a connector attached to the rear surface of the cover, wherein the connector is releasably attachable to a bass drum head.

In another aspect of the present invention, an apparatus comprises: a cover comprising a front surface and a rear surface, wherein the front surface comprises a printed display; a bass drum head; and at least one hook and loop fastener releasably attaching the cover to the bass drum head.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes custom printed removable bass drumhead that attaches on an existing drumhead and can be easily removed and interchanged. The present invention is easy to install, easy to remove and is interchangeable. Using the present invention, drummers no longer have to commit to anything permanent and can switch drumhead designs quickly with little effort.

The present invention may be manufactured in the following ways. A computer generated artwork may be printed on a pressure sensitive clear vinyl film and then applied to the polyvinyl chloride (PVC) backing. Alternatively, custom artwork may be printed directly to the PVC, then a clear coat gloss may be added. A hook and loop fastener (Velcro®) may releasably attach the custom printed artwork to the original bass drum head already in place.

Broadly, an embodiment of the present invention provides a removable bass drum head cover with a printed display. The drum head cover may be releasably attachable to a bass drum head. In certain embodiments, the drum head cover may be releasably attachable to the bass drum head cover by a hook and loop fastener. Therefore, drummers may easily interchange the designs, artwork, and band names displayed on their bass drum heads.

Figure 1:
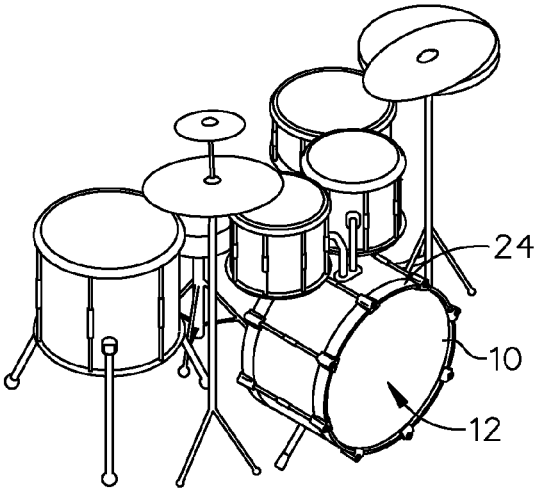
FIG. 1 is a perspective view of the present invention shown in use.
Figure 2:
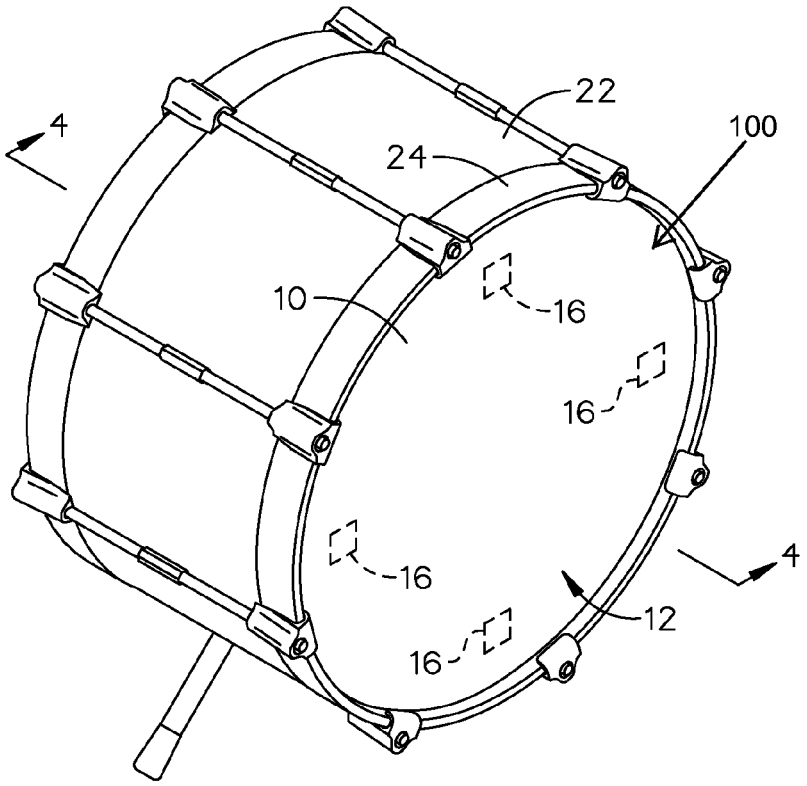
FIG. 2 is a perspective view of the present invention.
Figure 3:
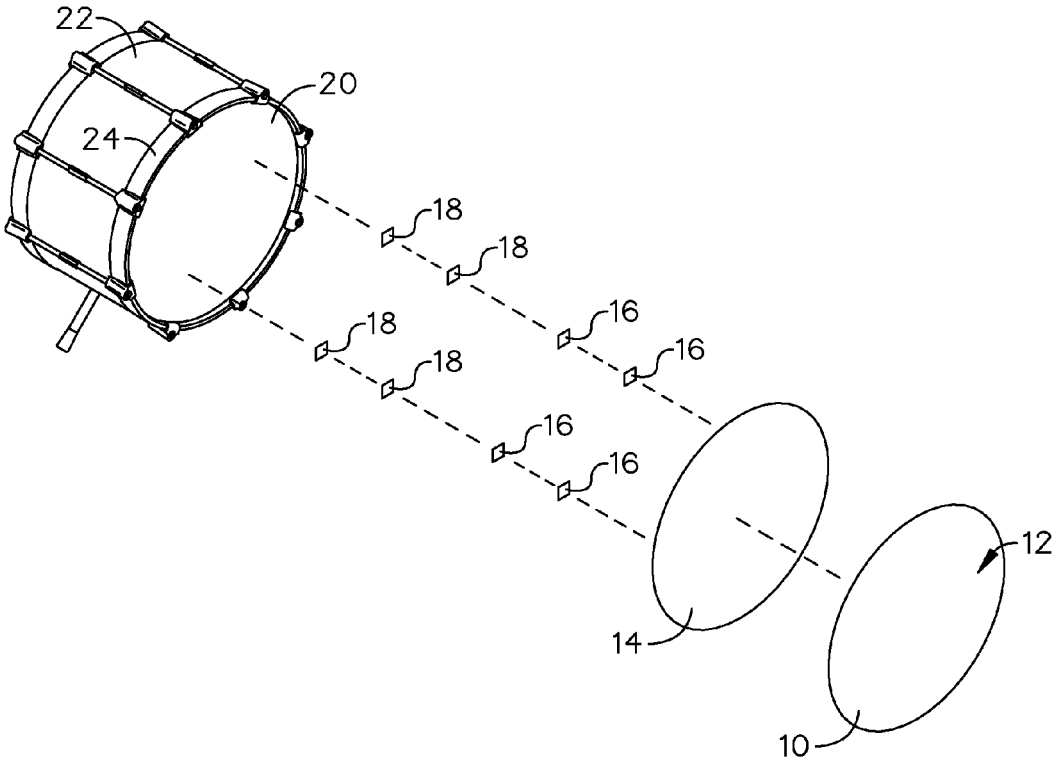
FIG. 3 is an exploded view of the present invention.
Figure 4:
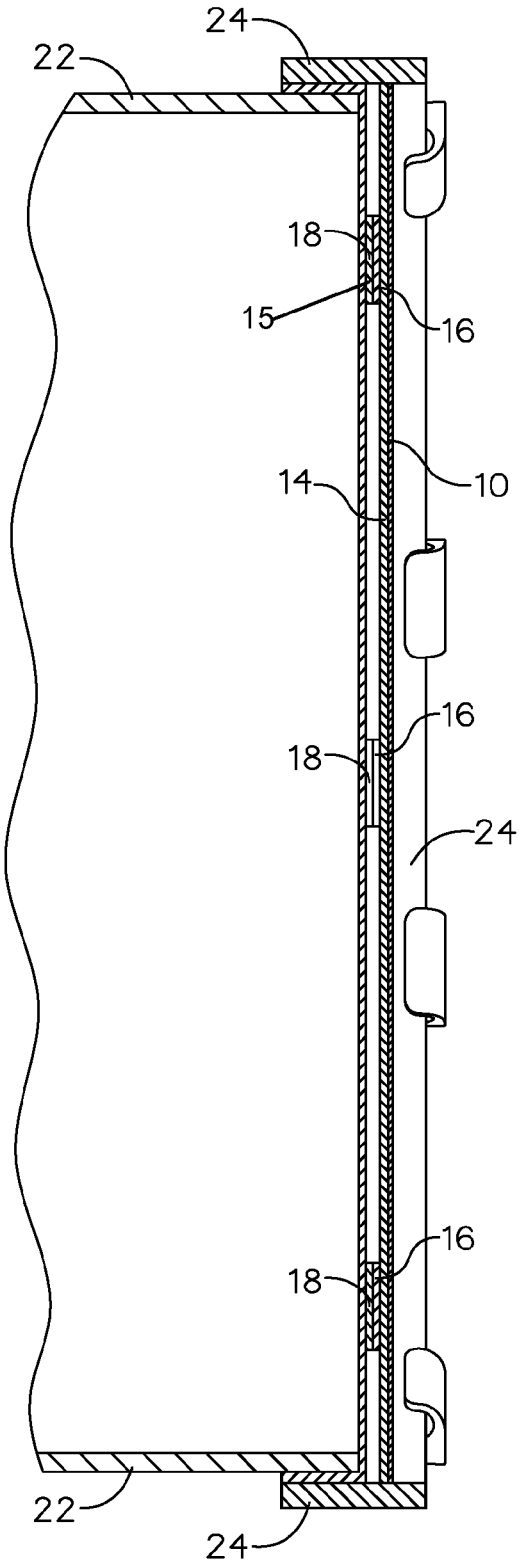
FIG. 4 is a section view of the present invention taken along line 4-4 in FIG. 2.
Figure 5:
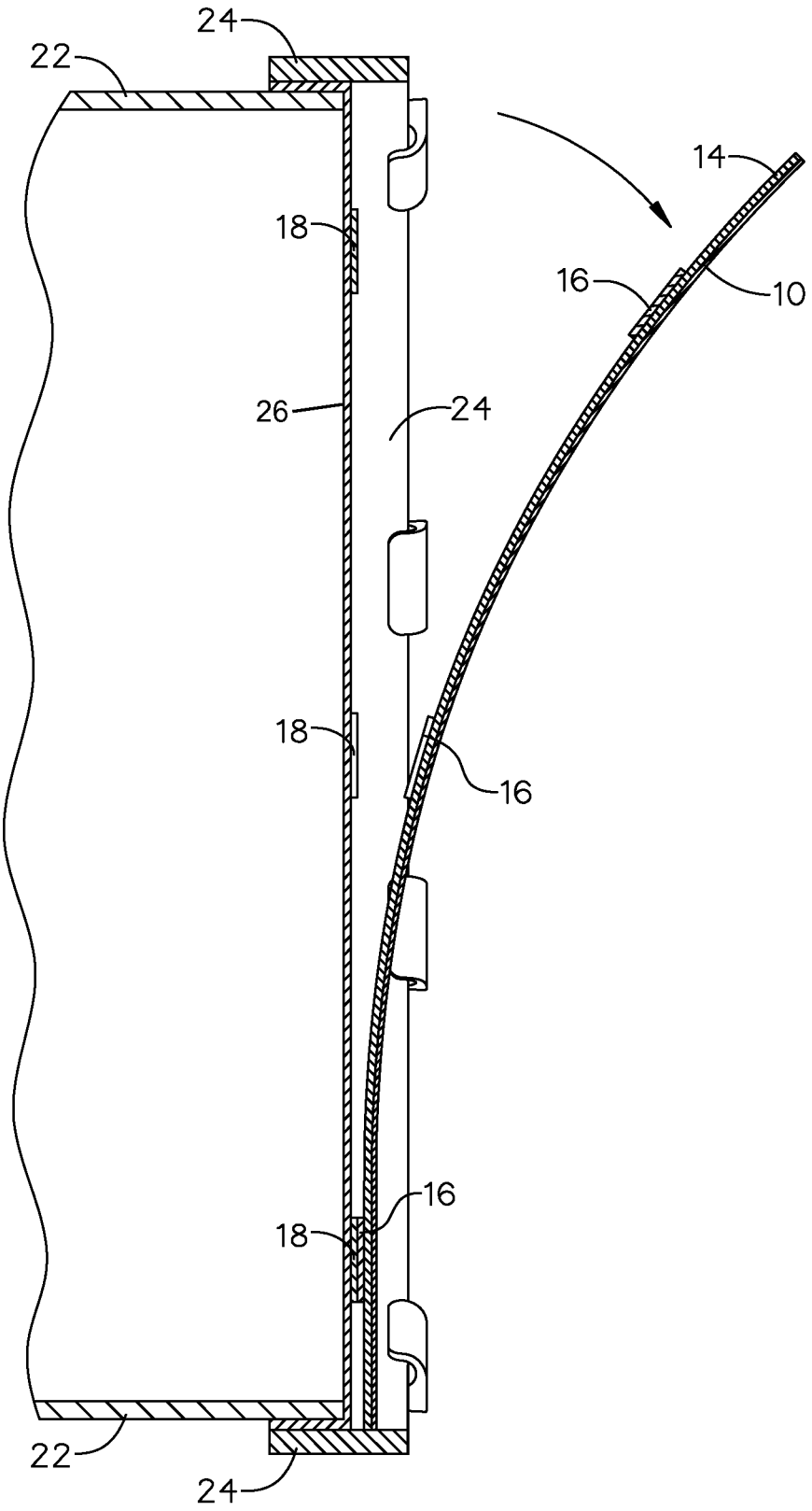
FIG. 5 is a section view of the present invention, illustrating the removal of the cover.

Referring to FIGS. 1 through 5, the present invention includes a custom printed removable bass drum head cover 100. The cover 100 includes a front surface and a rear surface. The front surface may include a printed display 12. The present invention may further include a bass drum 22 having a drum hoop 24 and a drum head 26. The present invention may further include a connector 15. The connector 15 may be attached to the rear surface of the cover 100 and may releasably attach the cover 100 to the bass drum head 26.

In certain embodiments, the cover 100 of the present invention may include a plurality of layers. As illustrated in the Figures, the present invention may include a backing layer 14 and a film layer 10. The film layer 10 may be a clear pressure-sensitive vinyl film. The printed display 12 may be printed onto the film layer 10. The backing layer 14 may be made of a polymer such as polyvinyl chloride (PVC). The present invention may further include a clear coat of gloss that is applied to the film layer 10.

As mentioned above the present invention includes a connector 15. The connector 15 may include at least one of a hook and loop fastener, magnets, snap buttons, clips, and, plugs. In certain embodiments, the connector 15 may include a male portion and a female portion. The male portion is releasably attachable to the female portion. The cover 100 may include at least one of the male portion and female portion, and the bass drum head 26 may include at least of the male portion and female portion releasably attachable to the at least one of the male portion and female portion of the cover 100.

In certain embodiments, the male portion may be a hooked fastener piece 16, and the female portion may be a looped fastener piece 18. In certain embodiments, the backing layer 14 may include at least one hooked fastener piece 16 and the bass drum head 26 may include at least one looped fastener piece 18. For example, the backing layer 14 may include four hooked fastener pieces 16 that align with and releasably attach to four looped fastener pieces 18 attached to the bass drum head 26.

A person could use multiple covers and interchange them with one another without committing to a permanent application to their existing drumhead. If a touring drummer uses a house drum set, he/she can travel with their drumhead and place it on any set he/she uses. If a drummer is in multiple bands, he/she can interchange band logos or artwork with ease and without the added expense. It can also be used as a type of interchangeable signage for advertising or display on any surface. The present invention may be produced in any size or shape.

It should be understood, of course, that the foregoing relates to exemplary embodiments of the invention and that modifications may be made without departing from the spirit and scope of the invention as set forth in the following claims.

What is claimed is:

1. An apparatus comprising:

a cover comprising a backing layer and a film layer, wherein the film layer comprises a printed display; and a connector attached to the backing layer, wherein the connector is releasably attachable to a bass drum head, wherein the connector comprises a male portion and a female portion, wherein the male portion is releasably attachable to the female portion, wherein the cover comprises at least one of the male portion and female portion, and the bass drum head comprises at least of the male portion and female portion releasably attachable to the at least one of the male portion and female portion of the cover.

2. The apparatus of claim 1, wherein the backing layer comprises at least one hooked fastener piece and the bass drum head comprises at least one looped fastener piece.

3. The apparatus of claim 1, further comprising a clear coat of gloss covering the printed display.

4. An apparatus comprising:

a cover comprising a backing layer and a film layer, wherein the film layer comprises a printed display;

a bass drum head; and at least one of a hook and loop fastener attached to the bass drum and at least one of a hook and loop fastener attached to the backing layer, wherein the hook and loop fastener of the bass drum and the hook and loop fastener of the backing layer releasably attach together, thereby attaching the cover to the bass drum head.

5. The apparatus of claim 4, wherein the backing layer comprises at least one hooked fastener piece and the bass drum head comprises at least one looped fastener piece.

6. The apparatus of claim 4, further comprising a clear coat of gloss covering the printed display.

* * * * *